US005516615A

United States Patent [19]

Tyagi et al.

[11] Patent Number: 5,516,615

[45] Date of Patent: May 14, 1996

[54] STABILIZED CARRIERS WITH β PHASE POLY(VINYLIDENEFLUORIDE)

[75] Inventors: Dinesh Tyagi, Fairport; James H. Anderson; Dennis E. DeMeyer, both of Rochester, all of N.Y.

[73] Assignee: Eastman Kodak Company, Rochester, N.Y.

[21] Appl. No.: 381,246

[22] Filed: Jan. 31, 1995

[51] Int. Cl.[6] ..... G03G 9/107; G03G 9/113

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| Re. 31,072 | 11/1982 | Jadwin et al. | 430/99 |
| 2,229,513 | 1/1941 | Lustig . | |
| 3,850,663 | 11/1974 | Hagenbach | 430/108 |
| 3,893,935 | 7/1975 | Jadwin et al. | 430/110 |
| 3,938,992 | 2/1976 | Jadwin et al. | 430/109 |
| 3,970,571 | 7/1976 | Olson et al. | 427/212 |
| 4,042,518 | 8/1977 | Jones | 252/62.62 |
| 4,076,857 | 2/1978 | Kasper et al. | 118/651 |
| 4,079,014 | 3/1978 | Burness et al. | 430/110 |
| 4,089,472 | 5/1978 | Siegel et al. | 241/5 |
| 4,160,644 | 7/1979 | Ryan . | |
| 4,323,634 | 4/1982 | Jadwin | 430/110 |
| 4,394,430 | 7/1983 | Jadwin et al. | 430/110 |
| 4,414,152 | 11/1983 | Santilli et al. | 430/114 |
| 4,416,965 | 11/1983 | Sandhu et al. | 430/109 |
| 4,478,925 | 10/1984 | Miskinis | 430/137 |
| 4,517,171 | 5/1985 | Jadwin et al. | 430/110 |
| 4,536,060 | 10/1985 | Miskinis et al. | 430/108 |
| 4,666,813 | 5/1987 | Sakashita | 430/110 |
| 4,684,596 | 8/1987 | Bonser et al. | 430/110 |
| 4,714,046 | 12/1987 | Steele et al. | 118/657 |
| 4,726,994 | 2/1988 | Yoerger | 430/108 |
| 4,737,435 | 4/1988 | Yoerger | 430/137 |
| 4,758,491 | 7/1988 | Alexandrovich et al. | 430/110 |
| 4,833,060 | 5/1989 | Nair et al. | 430/137 |
| 4,878,089 | 10/1989 | Guslits et al. | 355/253 |
| 5,192,637 | 3/1993 | Saito et al. | 430/109 |

FOREIGN PATENT DOCUMENTS

| | | | |
|---|---|---|---|
| 1148785 | 6/1983 | Canada | 430/108 |
| 1420839 | 1/1976 | United Kingdom . | |
| 1501065 | 2/1978 | United Kingdom . | |

OTHER PUBLICATIONS

M. Kobayashi et al, *Macromolecules,* vol. 8 (1981), pp. 158–171.

W. M. Priest, Jr. et al, *J. Appl. Phys.,* vol. 46 (1975), pp. 4136–4143.

M. A. Marcus, "Ferroelectric Polymers and Their Applications," paper presented at the Fifth International Meeting on Ferroelectricity at Pennsylvania State University, Aug. 1981.

*Primary Examiner*—Roland Martin

*Attorney, Agent, or Firm*—J. Jeffrey Hawley

[57] ABSTRACT

A method for converting α-phase poly(vinylidene fluoride) to β-phase poly(vinylidene fluoride), for preparing electrostatographic carrier and, electrostatographic developer and carrier. In the method for preparing electrostatographic carrier, uncoated electrostatographic carrier particles are coated with α-phase poly(vinylidene fluoride) to provide α-phase poly(vinylidene fluoride) coated carrier particles. A measurable portion of the α-phase poly(vinylidene fluoride) is then converted to β-phase poly(vinylidene fluoride) by subjecting the α-phase poly(vinylidene fluoride) to a series of viscoelastic collisions having a total energy of from about $5\times10^4$ to about $5\times10^5$ Joules/kilogram of poly(vinylidene fluoride).

7 Claims, 4 Drawing Sheets

STABILIZED CARRIERS WITH β PHASE POLY(VINYLIDENEFLUORIDE)

FIELD OF THE INVENTION

The invention relates to electrophotography and to poly(vinylidene fluoride). The invention more particularly relates to methods for changing α-phase poly(vinylidene fluoride) to β-phase poly(vinylidene fluoride) and to the modification of poly(vinylidene fluoride) coated electrophotographic carriers and to products of the methods.

BACKGROUND OF THE INVENTION

In electrostatography, image charge patterns are formed on a support and are developed by treatment with an electrostatographic developer containing marking particles which are attracted to the charge patterns. These particles are called toner particles or, collectively, toner. The image charge pattern, also referred to as an electrostatic latent image, is formed on an insulative surface of an electrostatographic element by any of a variety of methods. For example, the electrostatic latent image may be formed electrophotographically, by imagewise photo-induced dissipation of the strength of portions of an electrostatic field of uniform strength previously formed on the surface of an electrophotographic element comprising a photoconductive layer and an electrically conductive substrate. Alternatively, the electrostatic latent image may be formed by direct electrical formation of an electrostatic field pattern on a surface of a dielectric material.

One well-known type of electrostatographic developer comprises a dry mixture of toner particles and carrier particles. Developers of this type are commonly employed in cascade and magnetic brush electrostatographic development processes. The toner particles and carrier particles differ triboelectrically, such that during mixing to form the developer, the toner particles acquire a charge of one polarity and the carrier particles acquire a charge of the opposite polarity. The opposite charges cause the toner particles to cling to the carrier particles. During development, the electrostatic forces of the latent image, sometimes in combination with an additional applied field, attract the toner particles. The toner particles are pulled away from the carrier particles and become electrostatically attached, in imagewise relation, to the latent image bearing surface. The resultant toner image can then be fixed, by application of heat or other known methods, depending upon the nature of the toner image and the surface, or can be transferred to another surface and then fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface.

Carrier particles comprise a core usually coated with a polymer. Commonly used polymers include: silicone resin; acrylic polymers, such as, poly(methylmethacrylate); and vinyl polymers, such as polystyrene and combinations of materials. Another commonly used coating material is fluorohydrocarbon polymer, such as poly(vinylidene fluoride) or poly(vinylidene fluoride-co-tetrafluoroethylene). See, for example, U.S. Pat. Nos. 4,546,060; 4,478,925; 4,076,857; and 3,970,571. Such polymeric fluorohydrocarbon carrier coatings can serve a number of known purposes. One such purpose can be to aid the developer to meet the electrostatic force requirements mentioned above by shifting the carrier particles to a position in the triboelectric series different from that of the uncoated carrier core material, in order to adjust the degree of triboelectric charging of both the carrier and the toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces, such as photoconductive element surfaces, that they contact during use. Yet another purpose can be to reduce the tendency of toner material or other developer additives to become undesirably permanently adhered to carrier surfaces during developer use (often referred to as "scumming"). A further purpose can be to alter the electrical resistance of the carrier particles. All of these, and even more, purposes are well known in the art for polymeric fluorohydrocarbon carrier coatings. What is desired is a carrier coating that serves all of the above-noted purposes well, both initially and throughout a long useful life involving many replenishments of toner.

Additional problems are faced by carriers used in electrophotographic equipment in which there is a great deal of developer mixing, sometimes referred to as "exercising". Examples of such equipment is disclosed in U.S. Pat. Nos. 4,878,089 and 4,714,046. In such uses, loss of carrier charge with exercising or aging is one of the biggest problem encountered. This drop in charge with life leads to many problems which include unacceptable dusting, poor image quality and reduced reliability of the equipment. Among various techniques practiced to address this shortcoming, preconditioning of the developer is by far the most common. In preconditioning, carrier is mixed with toner, exercised and stripped before use in the electrophotographic copier or printer. This initial "aging" or treatment of the developer outside the equipment is expensive and labor intensive and only addresses the problem of initial charge instability. The problem that is not addressed is carrier aging that occurs when the developer is exercised extensively when a very low amount of toner is being developed or placed on each copy.

Various methods have been used to improve the characteristics of fluorocarbon coated carriers. For example, U.S. Pat. No. 4,737,435 to Yoerger, disclosed a method of dehydrofluorinating a fluorohydrocarbon carrier coating by contacting the coated carrier particles with a basic solution. The resulting change in chemical structure had the effect of repositioning the carrier triboelectrically. In another example, U.S. Pat. No. 4,726,994 to Yoerger, a method is disclosed for dehydrofluorinating and oxidizing a fluorohydrocarbon carrier coating by contacting the coated carrier particles with a basic solution and with an oxidizing agent. The resulting change in chemical structure also had the effect of repositioning the carrier triboelectrically, and in addition, decreased overcharging.

Polyvinylidene Fluoride ($PVF_2$) is commonly used as a carrier coating, because it has a position in a triboelectric series with a variety of electrophotographic toners that helps insure that a positive charge is imparted to the toner and a negative charge to the carrier surface. $PVF_2$ can exist in a non-polar α-phase, and polar β, and γ phases. $PVF_2$ is normally applied to carrier cores by melt coating at a temperature in the range of about 190° C. to 260° C.

$PVF_2$solidifies from a melt as α-phase. Melt coating is highly preferred over solvent coating for environmental reasons. M. Kobayashi, K. Tashiro and H. Tadokoro, *Macromolecules.*, Vol. 8, p. 158 (1975) teaches the preparation of α-phase $PVF_2$ by stretching melt-crystallized specimens or by rolling film speciments cast from dimethylacetamide solution. W. M. Priest, Jr., and D. J. Luca., J. Appl. Phys., Vol. 46, p. 4136 (1975) teaches the preparation of β-phase $PVF_2$ by poling. W. W. Doll and J. B. Lando, J. Macromol. Sci.-Phys., Vol. B2, p. 219 (1968) teaches the preparation of β-phase $PVF_2$ by high pressure crystallization. M. A. Marcus, paper presented at the Fifth International Meeting on Ferroelectricity at Pennsylvenia Sate University, Aug. 17–21, (1981) teaches the preparation of β-phase $PVF_2$ by plastic deformation under high pressure. Such procedures are expensive and complex.

There is thus a continuing need for a carrier that has good electrophotographic properties, both initially and throughout a long useful life involving many replenishments of toner and for developer incorporating that carrier. There is also a continuing need for a simple, inexpensive method for converting α-$PVF_2$ to β-$PVF_2$.

SUMMARY OF THE INVENTION

The invention, in its broader aspects, provides a method for converting α-phase poly(vinylidene fluoride) to β-phase poly(vinylidene fluoride), for preparing electrostatographic carrier and, electrostatographic developer and carrier. In the method for preparing electrostatographic carrier, uncoated electrostatographic carrier particles are coated with α-phase poly(vinylidene fluoride) to provide α-phase poly(vinylidene fluoride) coated carrier particles. A measurable portion of the α-phase poly(vinylidene fluoride) is then converted to β-phase poly(vinylidene fluoride) by subjecting the β-phase poly(vinylidene fluoride) to a series of viscoelastic collisions having a total energy of from about $5\times10^4$ to about $5\times10^5$ Joules/kilogram of poly(vinylidene fluoride).

It is an advantageous effect of at least some of the embodiments of the invention that there is provided a method for modifying electrophotographic carrier to provide a carrier that has good electrophotographic properties, both initially and throughout a long useful life. There is also advantageously provided a method for simply and inexpensively converting α-$PVF_2$ to β-$PVF_2$.

BRIEF DESCRIPTION OF THE FIGURES

The above-mentioned and other features and objects of this invention and the manner of attaining them will become more apparent and the invention itself will be better understood by reference to the following description of an embodiment of the invention taken in conjunction with the accompanying figures wherein.

DESCRIPTION OF PARTICULAR EMBODIMENTS

Figure 1:
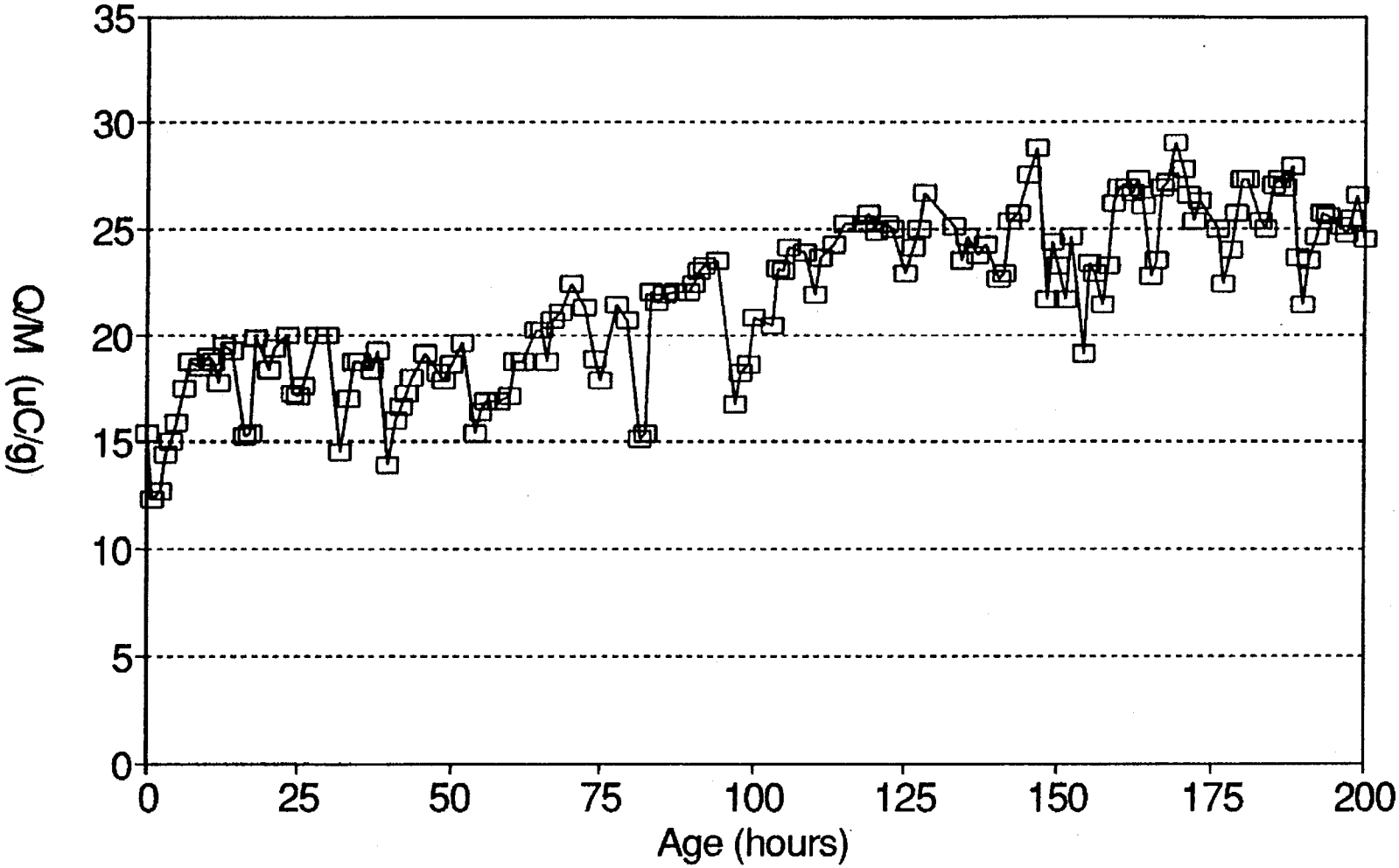
FIGS. 1–3 are diagrams of the results of Example 13.

The method of the invention provide a simple, economic procedure for converting α-phase poly(vinylidene fluoride) to β-phase $PVF_2$. In a preferred embodiment of the invention, the process is performed on $PVF_2$-coated carrier particles to yield the carrier of the invention. A developer of the invention, incorporating a carrier of the invention, provides an unexpected improvement in charge stability under unreplenished aging.

In the method of the invention, energy is imparted to an α-phase $PVF_2$ surface by a series of viscoelastic collisions of the surface and other objects. The result is a conversion of the impacted $PVF_2$ surface from α-phase to β-phase. The collisions have a total energy of from about $5\times10^4$ to about $5\times10^5$ Joules/kilogram of $PVF_2$. The energy is applied to the $PVF_2$ at a rate of from about 5 to about 500 Watts/kilogram of $PVF_2$.

The conversion of α-phase $PVF_2$ to β-phase can be detected by a variety of techniques. For example, techniques suitable for use on a $PVF_2$ coated particulate include x-ray diffraction at a suitable glancing angle and Fourier Transform Infrared Spectroscopy.

The $PVF_2$ surface can be a coating on a particulate material, or can be the coating on a panel or component made of another material, or can be the surface layer of a $PVF_2$ structural component.

The $PVF_2$ coating can be uniform, or discontinuous. The $PVF_2$ coating can also consist of crystalline $PVF_2$ regions within a coating of non-uniform composition. The remainder such a non-uniform coating can be selected from a wide variety of crystalline or amorphous polymers, as long as $PVF_2$rich regions are present. These $PVF_2$ rich regions may or may not consist of discrete domains. The additional polymer should not deleteriously interfere with the intended characteristics of a resulting product. For example, a low $T_g$ polymer could cause unacceptable clumping of a coated particulate. Examples of suitable coatings include: poly(methylmethacrylate) (PMMA), poly (styrene), poly(siloxanes), silsesquioxanes, and poly(tetrafluroethelyne).

The manner in which the energy is supplied to the $PVF_2$ surface, the nature of the viscoelastic collisions, depends upon the physical configuration of the $PVF_2$ surface. For example, a large component coated with $PVF_2$ can be impacted with a high velocity flow of particulate, or beads, or the like. This is generally comparable to a variety of well-known procedures, for example, shot-peening; and details of suitable techniques are well-known to those of skill in the art of surface treatment.

With a coated particulate, collisional energy can be supplied by impacting particles against each other. A variety of pulverizing and mixing apparatus, designed to subject particulate materials to high shear, are suitable for this purpose. Examples of such equipment are: Processall mixer (manufactured by Processall Corp. Cincinnati, OH.), high shear blender, fluid energy mill, ball mill. The magnetic particles could also be impacted in a clean developer station removed from a Kodak 1575 Copier-Duplicator (manufactured by Eastman Kodak Company, Rochester, N.Y.) or the equivalent.

In a preferred embodiment, the method of the invention is performed on carrier cores coated with $PVF_2$. The term "coated" should not be understood to suggest or imply that the surface of the carrier cores is necessarily completely covered with a uniform layer of $PVF_2$. The $PVF_2$ may be coated over the bare cores on a very non-uniform basis such that the $PVF_2$ "coating" is seen as separated dark spots in electron micrographs of carrier core particles.

In the method of the invention, the coated carrier particles are placed in a high shear pulverizing device and the particles are impacted against each other until at least 50 percent of the $PVF_2$ surface has been converted from α-phase to β-phase. The 50 percent figure here refers to a mole percent of the surface as measured by glancing angle x-ray diffraction or the equivalent. It is expected that subsurface portions of $PVF_2$ will have a lesser percentage of α to β conversion. Carrier cores often have extensive surface convolutions. Those convolutions are less accessible to $PVF_2$ coating, α to β conversion, and surface analysis than non-convoluted portions of the carrier and as a result can be ignored in considerations of $PVF_2$ coating and conversion.

The method of the invention cannot be performed if necessary collisional energy is absorbed by some material other than the α-phase poly(vinylidene fluoride). For example, the α-$PVF_2$coating on carrier particles, will not convert to β-$PVF_2$ if the carrier particles are mixed with toner and then impacted together.

The method of the invention can be performed on carrier particles having $PVF_2$ as their only surface coating or having a coating applied as a mixture of $PVF_2$ and another polymer. If carrier particles can have coats applied as multiple "layers", that is, applied in a multiple step process; however, the $PVF_2$must remain subject to the energetic collisions required by the method of the invention.

The carrier particles, also referred to as "carrier cores", can be conductive, non-conductive, magnetic, or non-magnetic. Carrier particles can be glass beads; crystals of inorganic salts such as aluminum potassium chloride, ammonium chloride, or sodium nitrate; granules of zirconia, silicon, or silica; particles of hard resin such as poly(methyl methacrylate); or particles of elemental metal or alloy or oxide such as iron, steel, nickel, carborundum, cobalt, oxidized iron and mixtures of such materials. Examples of carrier cores are disclosed in U.S. Pat. Nos. 3,850,663 and 3,970,571. Especially useful in magnetic brush development procedures are iron particles such as porous iron particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. Nos. 4,042,518; 4,478,925; and 4,546,060. Currently preferred are strontium ferrite carrier particles.

In currently preferred embodiments of the invention, the $PVF_2$ is coated over strontium ferrite carrier particles on an about 0.001 percent to about 5 percent weight/weight basis. Coating percentages outside this range may be utilized, however, concentrations of coating which would cover an excessive portion of the surface of the carrier particles may render electrophotographic properties of the resulting carrier unaccept. A suitable coating percentage can be determined by simple experimentation. If it is desirable to provide uniform coatings for batches of carrier having different particle sizes, then the coating concentration should be adjusted to provide a uniform weight of $PVF_2$ per unit surface area of carrier. A convenient coating concentration is a 2.0 percent weight/weight basis when using about 25 microns volume average particle size. (The term "particle size" used herein, or the term "size", or "sized" as employed herein in reference to the term "particles", means the median volume weighted diameter as measured by conventional diameter measuring devices, such as a Coulter Multisizer, sold by Coulter, Inc of Hialeah, Fla. Median volume weighted diameter is the diameter of an equivalent weight spherical particle which represents the median for a sample.)

In preparing the developer of the invention, carrier particles prepared by the method of the invention can be mixed with other carrier particles, for example, PMMA coated carrier particles.

Carrier of the invention can be used in combination with a wide variety of toners known in the art to be useful in combination with PVF2-coated carrier particles and with any of the sizes and size ratios known to be useful for such particles, to serve as dry electrostatographic developers in any of the well known dry electroscopic development schemes, for example, cascaded development or magnetic brush development.

In a particular embodiment, the developer of the invention contains from about 1 to about 20 percent by weight of toner and from about 80 to about 99 percent by weight of carrier of the invention. Usually, carrier particles are larger than toner particles. Conventional carrier particles have a particle size of from about 5 to about 1200 micrometers and are generally from 20 to 200 micrometers. Typically, and illustratively, the toner particles have an average diameter between about 2.0 micrometers and about 100 micrometers, and desirably have an average diameter in the range of from about 5.0 micrometers and 30 micrometers for currently used electrostatographic processes.

It is a characteristic of the developer of a preferred embodiment of the invention that the charge development is uniform, that is, that substantially all of the individual toner particles exhibit a triboelectric charge of the same sign with respect to a given carrier. Toner in a preferred embodiment of the invention achieves and maintains a positive charge. Toner throw-off is minimimal. The term "toner throw-off" refers to the amount of toner powder thrown out of a developer mix as it is mechanically agitated, for example, within a development apparatus. Throw-off can cause unwanted background development and general contamination problems.

The properties of the thermoplastic polymers employed as the toner matrix phase in the present invention can vary widely. Typically, and preferably, amorphous toner polymers having a glass transition temperature in the range of about 50° C. to about 120° C. or blends of substantially amorphous polymers with substantially crystalline polymers having a melting temperature in the range of about 65° C. to about 200° C. are utilized in the present invention. Preferably, such polymers have a number average molecular weight in the range of about 1000 to about 500,000. The weight average of molecular weight can vary, but preferably is in the range of about $2\times10^3$ to about $1\times10^6$. Preferably, the thermoplastic polymers used in the practice of this invention are substantially amorphous. However, as indicated above, mixtures of polymers can be employed, if desired, such as mixtures of substantially amorphous polymers with substantially crystalline polymers.

Polymers useful as binders in the developer of the invention include styrenic/acrylic copolymers. In general, preferred styrenic/acrylic copolymers have a glass transition temperature in the range of about 50° C. to about 100° C. In a particular embodiment of the invention, the resin is a copolymer of styrene and butyl acrylate, crosslinked with divinyl benzene; produced in a suspension or emulsion polymerization process. An initiator and, optional, a chain transfer agent are used in the synthesis. The ratio of styrene to butyl acrylate is in the range of from 90:10 to 60:40 and the divinyl benzene is used at a level of 0.1 to 1.0 weight percent. A specific example of a toner binder useful in the invention is disclosed in U.S. Pat. No. 3,938,992.

The toner can include charge control agent in an amount effective to modify, and preferrably, improve the properties of the toner. It is preferred that a charge control agent improve the charging characteristics of a toner, so the toner quickly charges to a desired value and then maintains about the same level of charge over a relatively extended time period. In a currently preferred embodiment of the invention, a positive charge control agent is used. Examples of charge control agents useful in developers of the invention are disclosed in U.S. Pat. Nos. 3,893935; 4,079,014; and 4,323,634 and British Pat. Nos. 1,501,065; and 1,420,839. Charge control agents are employed in small quantities such as, from about 0.1 to about 3 weight percent, or typically from about 0.2 to about 1.5 weight percent, all relative to the weight of the toner. Some examples of charge control agents are quaternary ammonium salts that have long hydrocarbon groups, such as: stearyl dimethyl benzyl ammonium chloride, lauramidopropyl trimethyl ammonium methylsulfate and p-nitrobenzyl dimethyloctadecyl ammonium chloride.

A variable component of the toner is colorant: a pigment or dye. Suitable dyes and pigments are disclosed, for example, in U.S. Pat. No. Re. 31,072 and in U.S. Pat. Nos. 4,160,644; 4,416,965; 4,414,152; and 2,229,513. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent.

The toner can also contain other additives of the type used in previous toners, including leveling agents, surfactants, stabilizers, and the like. The total quantity of such additives can vary. A present preference is to employ not more than about 10 weight percent of such additives on a total toner powder composition weight basis.

Suitable dry styrene-acrylic copolymer toners can optionally incorporate a small quantity of low surface energy material in combination with toner particles comprised of polyester polymer, as described in U.S. Pat. Nos. 4,517,272 and 4,758,491. Optionally the toner can contain a particulate additive on its surface such as the particulate additive. disclosed in U.S. Pat. No. 5,192,637.

The charge control agent and other addenda can be added to the toner in a number of ways. For example, in a dry electrostatographic-toner, the charge control agent can be mix-blended in the manner described in U.S. Pat. Nos. 4,684,596 and 4,394,430, with an appropriate polymeric binder material and any other desired addenda. The mixture is then ground to desired particle size to form a free-flowing powder of toner particles containing the charge agent. A preformed mechanical blend of particulate polymer particles, charge control agent, colorants and additives can, alternatively, be roll milled or extruded at a temperature sufficient to melt blend the polymer or mixture of polymers to achieve a uniformly blended composition. The resulting material, after cooling, can be ground and classified, if desired, to achieve a desired toner powder size and size distribution. For a polymer having a $T_g$ in the range of about 50° C. to about 120° C., or a $T_m$ in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes. After melt blending and cooling, the composition can be stored before being ground. Grinding can be carried out by any convenient procedure. For example, the solid composition can be crushed and then ground using, for example, a fluid energy or jet mill, such as described in U.S. Pat. No. 4,089,472. Classification can be accomplished using one or two steps.

In place of mix or melt blending, the polymer can be dissolved in a solvent in which the charge control agent and other additives are also dissolved or are dispersed. The resulting solution can be spray dried to produce particulate toner powders. Limited coalescence polymer suspension procedures as disclosed in U.S. Pat. No. 4,833,060 are particularly useful for producing small sized, uniform toner particles.

The carrier and developer of the invention can be used in a variety of ways to develop electrostatic charge patterns or latent images. Such developable charge patterns can be prepared by a number of means can can be carried, for example, on a light sensitive photoconductive element or a non-light-sensitive dielectric surface element, such as an insulator coated conductive sheet. One suitable development technique involves cascading developer across the electrostatic charge pattern. Another technique involves applying toner particles from a magnetic brush. This technique involves the use of magnetically attractable carrier cores. After imagewise deposition of the toner particles the image can be fixed, for example, by heating the toner to cause it to fuse to the substrate carrying the toner. If desired, the unfused image can be transferred to a receiver such as a blank sheet of copy paper and then fused to form a permanent image.

The following Examples and Comparative Examples are presented to further illustrate some preferred modes of practice of the invention. Unless otherwise indicated, all starting materials were commercially obtained.

Comparative Examples 1–4

Carrier was prepared by melt coating 2 parts per hundred of $PVF_2$ (Kynar 301F) onto a strontium based hard ferrite carrier core. Developer was prepared by mixing the carrier with a styrene/acrylic toner having a positive charge control agent and carbon black pigment (Ektaprint K toner, marketed by Eastman Kodak Company of Rochester, N.Y.). The developer toner concentration was varied from 8 to 16 weight percent in Comparative Examples 1 through 4. The charge to mass measurements were made on MECCA device using a fully charged developer. The MECCA measurement method involves first preparing 4.0 grams of developer by mixing the toner with carrier particles. The mixture was gently agitated in a appropriate bottle or vial to allow the developer to reach its optimum maximum charge. This was achieved by a wrist-action-robot shaker operating at 2 Hz and an overall amplitude of 11 cm, for 2 minutes. The toner charge level was measured by placing 0.05 to 0.2 grams of charged developer in a sample dish situated between electrode plates and subjecting it, simultaneously for 30 seconds, to a 60 Hz magnetic field to cause developer agitation and to an electric field of about 2000 volts/cm between the plates. Some toner is released from the carrier surface and is attached to and collected on the plate having polarity opposite to the toner charge. The total toner charge was measured by an electrometer connected to the plate. The toner charge divided by the weight of the toner on the plate yielded the charge to mass of toner in microcoulomb per gram (μCoul/gm). The aged or exercised charge/mass results were obtained on an exercised developer by placing 4.0 grams of developer into plastic vials, capping the vials, and placing each vial, for 10 minutes on a "bottle brush" device comprising a magnetic toner roller with a stationary shell and a magnetic core rotating at 2000 rpm. The magnetic core had 12 magnetic poles arranged around its periphery in alternating north-south fashion. The charge to mass measurements were performed on each aged developer using the MECCA device as described above.

TABLE I

Charge/Mass Results on Various Developers based on Ektaprint K Toner and 2 pph Kynar Coated Ferrite Carrier

| Comp. Ex. | Toner conc (wt %) | Fresh TC (wt %) | Fresh Q/M (μC/g) | 10 min BB TC Devpd | 10 min BB Q/M (μC/g) |
|---|---|---|---|---|---|
| Comp. Ex 1 | 8 | 8.2 | 31.3 | 7.3 | 6.7 |
| Comp. Ex. 2 | 10 | 10.0 | 31.8 | 9.6 | 8.6 |
| Comp. Ex. 3 | 12 | 11.7 | 30.6 | 11.6 | 12.6 |
| Comp. Ex. 4 | 16 | 15.8 | 27.7 | 15.7 | 15.0 |

These results show that the charge of the toner drops when developer is aged without replenishment. The data show that higher toner concentration is better for reducing the effect of unreplenished aging.

EXAMPLE 5a–5g

In this example, the mechanical deformation of the carrier was carried out by placing the coated carrier alone for various time periods on a magnetic brush roller in which the core was rotated at 2000 rpm. The core consisted of alternating north-south placement of the magnets along the periphery of the shell. The stabilized carrier was then used to prepare developer samples at 12 percent toner concentartion using the same toner as in Example 1–4. The charge to mass results obtained on the MECCA device are summarized in Table II. The results shows that when the carrier had been subjected to mechanical deformation by placing it on a magnetic roller for various time intervals, causing a phase transformation from α to β form an improvement in the aging behavior of the developer is realized.

TABLE II

Charge/Mass Results on Various Developers based on Ektaprint K Toner and 2 pph Kynar Coated Ferrite Carrier at 12% TC

| Ex. | Bottle Brush Exercise Time | Fresh TC | Fresh Q/M (μC/g) | 10 min BB TC Devpd | 10 min BB Q/M (μC/g) |
|---|---|---|---|---|---|
| Ex. 5a | 0 | 11.7 | 30.6 | 11.6 | 12.6 |
| Ex. 5b | 0.5 | 12.4 | 32.3 | 11.8 | 20.6 |
| Ex. 5c | 1.0 | 12.5 | 33.6 | 11.8 | 23.7 |
| Ex. 5d | 2.0 | 12.5 | 32.4 | 12.2 | 29.6 |
| Ex. 5e | 4.0 | 12.4 | 30.3 | 12.2 | 30.7 |
| Ex. 5f | 8.0 | 12.3 | 31.2 | 12.3 | 29.4 |
| Ex. 5g | 16.0 | 12.3 | 30.0 | 12.1 | 29.4 |

COMPARATIVE EXAMPLES 5–6 AND EXAMPLES 6–7

For the purpose of controlling the charge/mass of the developer, carrier coating were also prepared in substantially the same manner as the previous Examples using a mixture of $PVF_2$ and poly(methylmethacrylate) (PMMA) at 2 pph of total coverage. The charge to mass results for developers based on these carriers are shown in Table III.

EXAMPLE 8

In an alternate method to provide mechanical deformation to the carrier surface, the coated carrier was placed in a Processall device and agitated for 4 hours. Following this mechanical agitation, the exercised carrier was used to prepare developers in substantially the same manner as in the previous examples and the results are presented in Table III. The comparison between Example 7 and 8 exhibits that similar improvement can be realized equally by both methods of stabilization. Compared to the unstabilized carrier, the stabilization method of the invention helps in charge stability. But the with less than 100 percent Kynar coated carrier, the biggest improvement is found in the formation of correct signed particles. The last example in Table III involves carrier stabilization in Processall as opposed to magnetic brush. Similar improvement in performance is observed with this technique of carrier stabilization.

TABLE III

Charge/Mass Results on Various Developers based on Ektaprint K Toner and Various Coated Ferrite Carrier at 10% T.C.

| C. Ex and Ex. | Carrier | Fresh TC | Fresh Q/M (μC/gm) | 10 min BB TC Devpd | 10 min BB Q/M (μC/gm) |
|---|---|---|---|---|---|
| C. Ex. 5 | 1 pph Fresh | 10.2 | 24.2 | 5.5 | 1.8 |
| Ex. 6 | 1 pph Aged | 10.1 | 22.7 | 9.7 | 13.6 |
| C. Ex. 6 | 1.5/0.5 Fresh | 10.4 | 20.5 | 7.3 | 3.0 |
| Ex. 7 | 1.5/0.5 Aged | 10.1 | 20.0 | 9.4 | 7.5 |
| Ex. 8 | 1.5/0.5 Aged Processall | 10.4 | 22.1 | 9.3 | 6.0 |

COMPARATIVE EXAMPLES 7–10 AND EXAMPLES 9–12

These examples and comparative examples consist of various carrier coatings of Kynar and PMMA prepared in substantially the same manner as the previous examples except for the substitution of blue pigment in place of carbon. All carriers were impacted in a Processall for 4 hours to help stabilize the charge. The charge/mass results for these carriers along with their controls are presented in Tables IVa–IVb. All results show that the method of the invention provides unexpected charge stability results. Additionally, this approach is also very economical and simple.

EXAMPLE 13

The off-line machine performance of developers prepared with stabilized carriers was carried out a LTD device. The LTD device consists of a developer station about 4 inches long which is similar in design to the developer station in a Kodak 1575 Copier Duplicator. It holds approximately 250 g of developer. Developer is skived to control the thickness of the developer nap. Toner is developed onto a rotating drum by imposing a bias of 0 to 200 volts between the developer roller and the drum. The drum is cleaned by a steel blade, and the used toner is conveyed into a collection bottle. The toner concentration is controlled by a magnetic monitor which drives a toner replenisher.

A manifold is fitted to the top of the developer station and connected to laboratory vacuum through a filter. Dust generated in the development nip is collected in the filter and weighed periodically. Thus, the rate of dusting can be determined as the developer ages. This dust is referred to below as "on-line" dust.

Figure 2:
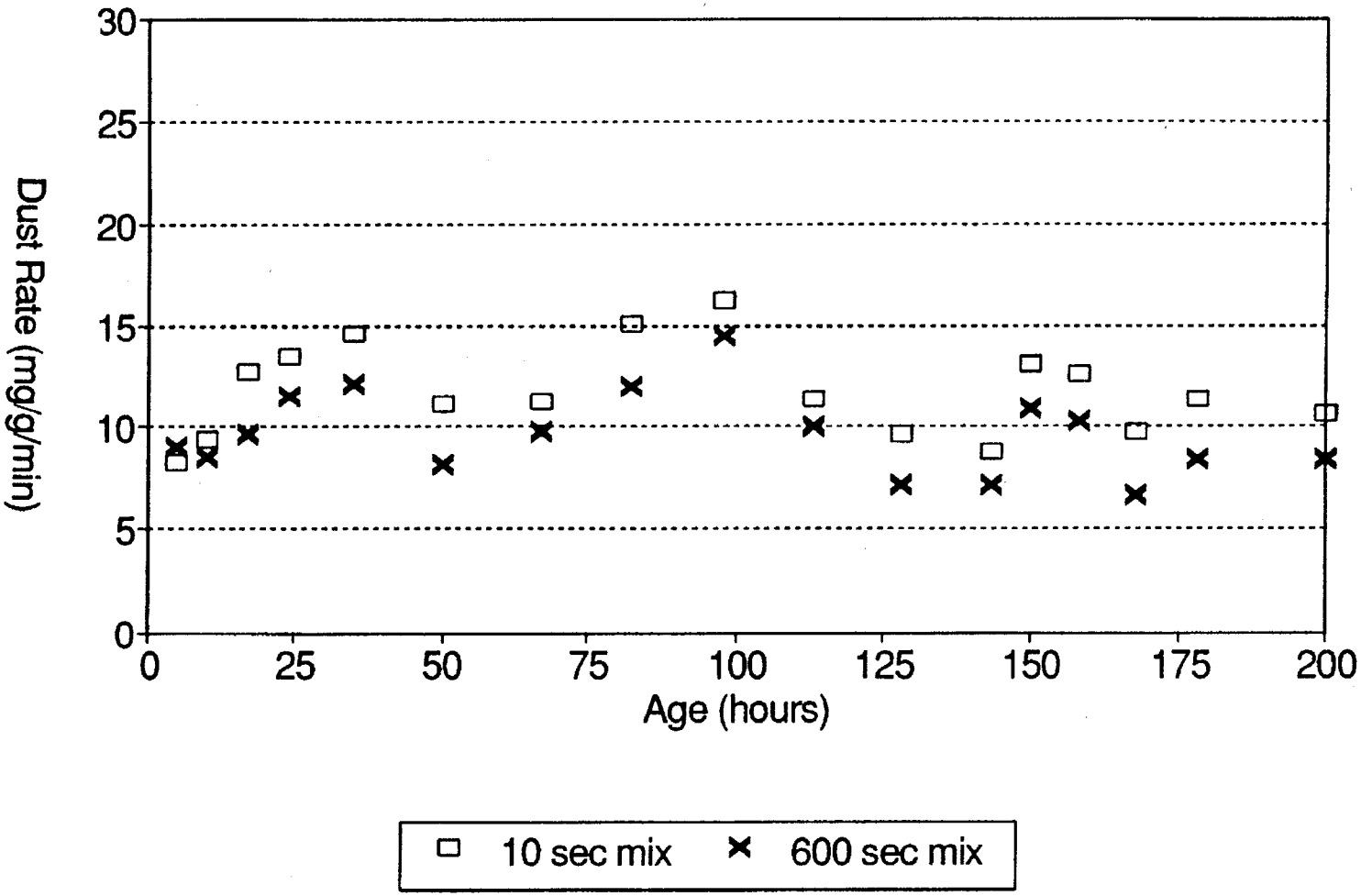
Figure 3:
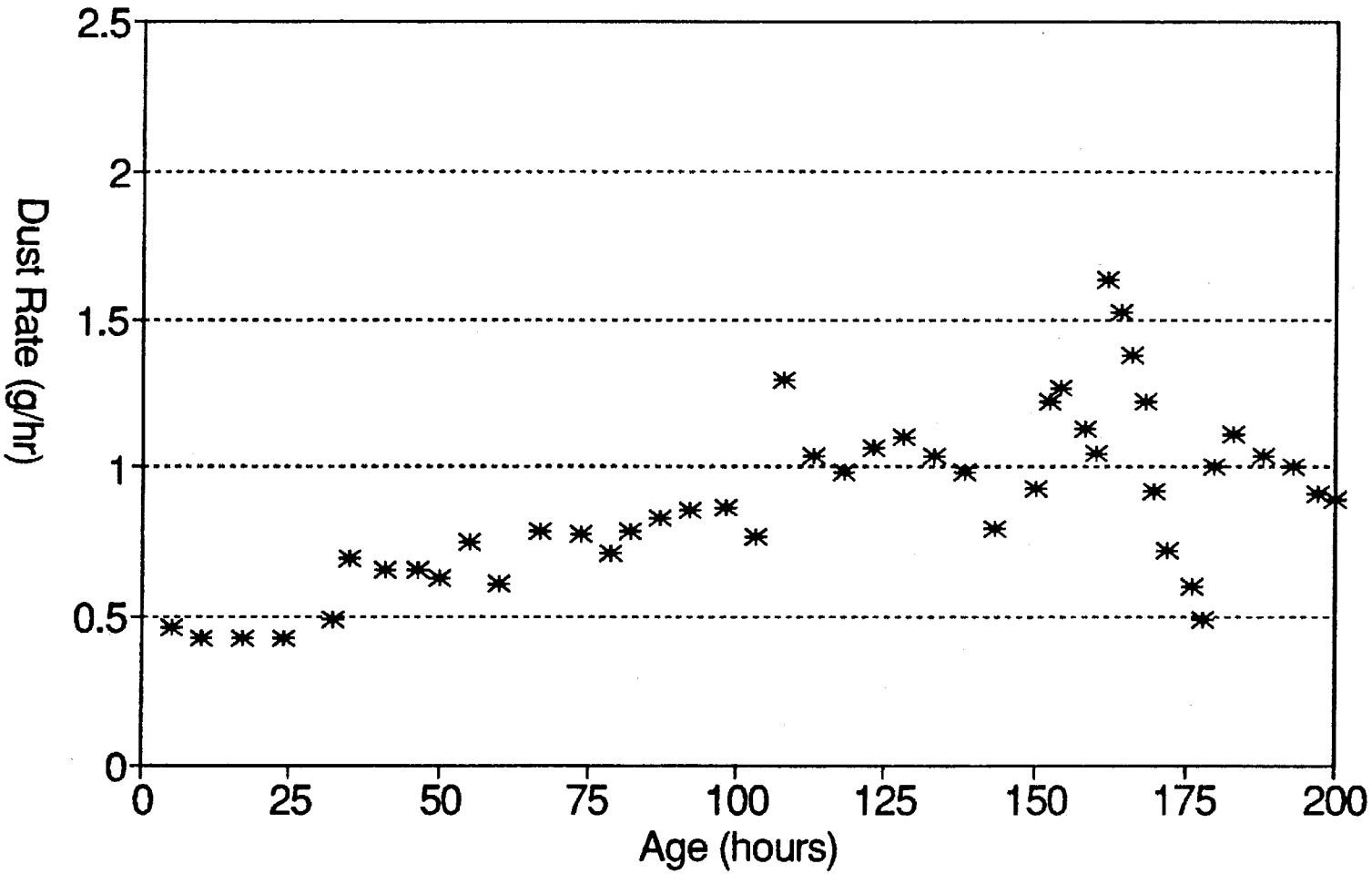

The toner replenishment rate is about 0.1 gram of toner per gram of developer per hour which is similar to toner usage expected for a 1575 copier-duplicator. Therefore, each hour of testing corresponds to about 4000 copies. The charge/mass and dusting data are shown in FIGS. 1–3.

EXAMPLE 14

Figure 4:
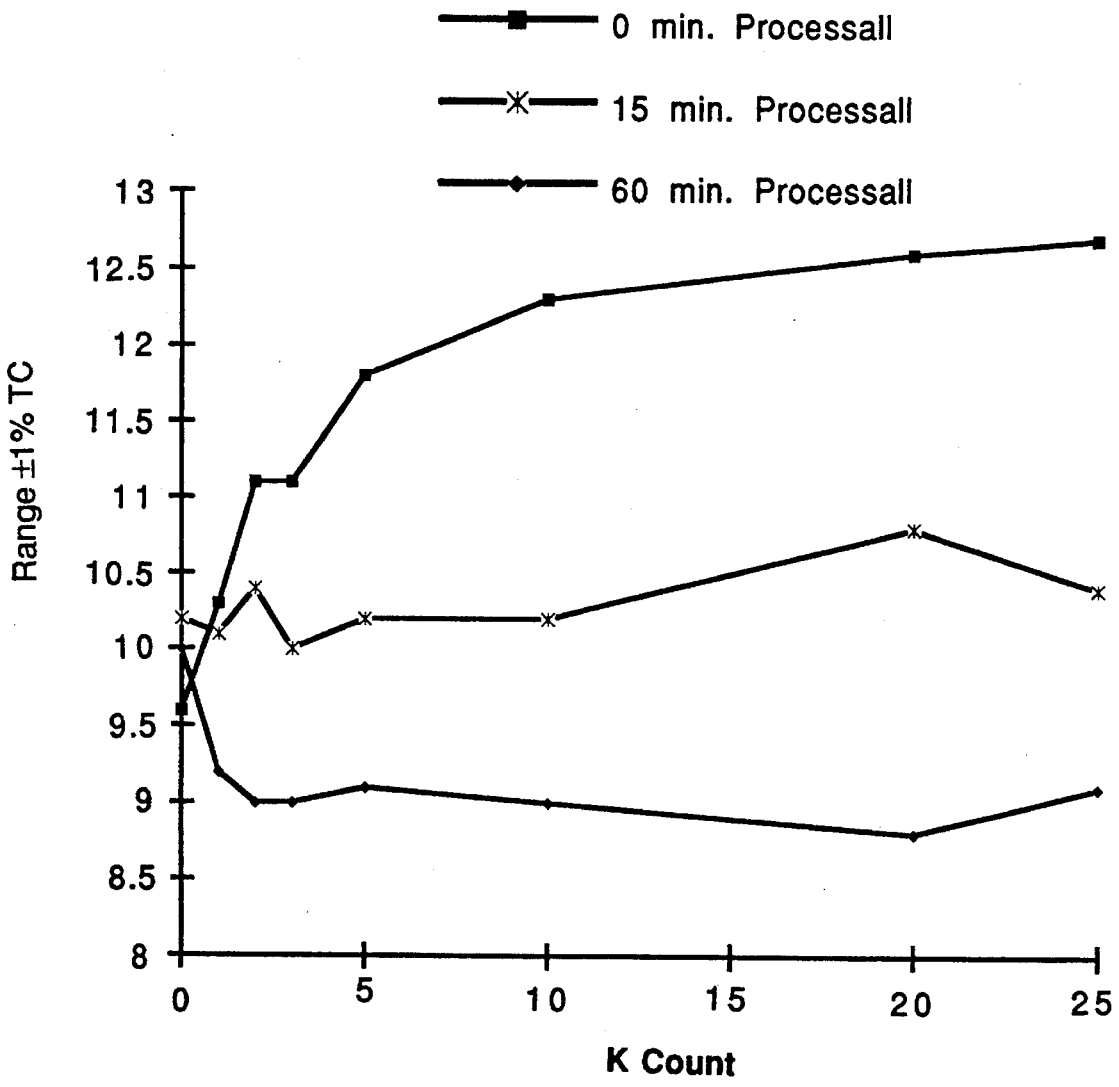
FIG. 4 is a diagram of the results of Example 14.

Developers were prepared as in Example 8, but with different stabilization times in the Proccessal device. Results were then obtained using an Ektaprint 2085 copier equipped with a SPD developer station (as disclosed in U.S. Pat. No. 4,878,089, which is hereby incorporated herein by reference. FIG. 4 shows the results of the different developers in this machine in which the carrier had been stabilized for various time intervals on a Processall machine. The results again confirm the developer stability in a machine environment. The increase in the stabilization time also help in the overall process stability as flat toner concentration and Vzero response are obtained. This carrier conditioning approach does not affect the overall image quality as indicated by the measurements on linewidth ratio, 0.6 neutral density mottle, solid area mottle and background.

TABLE IVa

Charge/Mass Results on Various Developers based on Various Stabilized Carriers with Blue Toner at 10% TC

| Ex. or C. Ex. | Kynar/PMMA | Stabilization | Fresh TC | Fresh Q/M |
|---|---|---|---|---|
| C. Ex. 7 | 0.6/0.9 | No | 8.3 | 3 |
| Ex. 9 | | Yes | 10.1 | 9.0 |
| C. Ex. 8 | 1.3/0.7 | No | 10.0 | 10.0 |
| Ex. 10 | | Yes | 10.0 | 10.0 |
| C. Ex. 9 | 1.4/0.6 | No | 9.4 | 11.0 |
| Ex. 11 | | Yes | 10.6 | 13.0 |
| C. Ex. 10 | 1.5/0.5 | No | 9.6 | 13.0 |
| Ex. 12 | | Yes | 10.0 | 15.0 |

TABLE IVb

Charge/Mass Results on Various Developers based on Various Stabilized Carriers with Blue Toner at 10% TC

| Ex. or C. Ex. | 10 min TC | 10 min Q/M | 1 Hr TC | 1 Hr Q/M |
|---|---|---|---|---|
| C. Ex. 7 | 0 | 0 | -ve | -ve |
| Ex. 9 | 9.7 | 5.0 | 1.3 | 9.0 |
| C. Ex. 8 | 9.6 | 4.0 | 1.9 | 5.0 |
| Ex. 10 | 10.0 | 10.0 | 8.3 | 4.0 |
| C. Ex. 9 | 9.1 | 6.0 | 3.0 | 5.0 |
| Ex. 11 | 10.5 | 16.0 | 10.2 | 6.0 |
| C. Ex. 10 | 9.7 | 11.0 | 7.9 | 2.0 |
| Ex. 12 | 10.1 | 22.0 | 9.7 | 10.0 |

While specific embodiments of the invention have been shown and described herein for purposes of illustration, the protection afforded by any patent which may issue upon this application is not strictly limited to a disclosed embodiment; but rather extends to all modifications and arrangements which fall fairly within the scope of the claims which are appended hereto:

What is claimed is:

1. An electrostatographic carrier comprising: carrier cores having a coating of poly(vinylidene fluoride), said polyvinylidene fluoride having a surface exposed to the ambient environment, said surface being at least 50 mole percent β-phase poly(vinylidene fluoride).

2. The carrier of claim 1 wherein said poly(vinylidene fluoride) has a concentration relative to said carrier cores of from about 0.001 weight/weight percent to about 5 weight/weight percent.

3. The carrier of claim 1 wherein said carrier cores are metallic.

4. The carrier of claim 1 wherein said carrier cores are strontium ferrites.

5. Electrophotographic developer comprising the carrier of claim 1 and toner.

6. The developer of claim 5 wherein said toner further comprises styrenic/acrylic copolymer.

7. The developer of claim 5 wherein said toner further comprises a positive charge control agent.

* * * * *